US005437700A

United States Patent [19]

Duquesne

[11] Patent Number: 5,437,700

[45] Date of Patent: Aug. 1, 1995

[54] POLYESTER/VISCOSE COMPOSITE YARNS AND FABRIC MATERIAL CONTAINING SAID YARNS AS FLEXIBLE COATED ABRASIVE SUPPORT

[75] Inventor: Simon Duquesne, Chatou, France

[73] Assignee: Minnesota Mining and Manufacturing Company, St. Paul, Minn.

[21] Appl. No.: 30,469

[22] PCT Filed: Oct. 3, 1991

[86] PCT No.: PCT/US91/07320

§ 371 Date: Apr. 2, 1993

§ 102(e) Date: Apr. 2, 1993

[30] Foreign Application Priority Data

Oct. 3, 1990 [FR] France ..... 90 12173

[51] Int. Cl.[6] ..... B24D 11/02

[52] U.S. Cl. ..... 51/295; 451/532; 451/536

[58] Field of Search ..... 51/295, 296, 298, 400, 51/DIG. 19; 451/532, 536, 539

[56] References Cited

U.S. PATENT DOCUMENTS

| | | | |
|---|---|---|---|
| 3,316,072 | 4/1967 | Voss | 51/294 |
| 4,035,961 | 7/1977 | Pemrick et al. | 51/295 |
| 4,282,011 | 8/1981 | Terpay | 51/298 |

FOREIGN PATENT DOCUMENTS

| | | | |
|---|---|---|---|
| 2205902 | 5/1974 | France | D02G 3/00 |
| 2578860 | 9/1986 | France | D02G 1/00 |
| 2539416A1 | 3/1977 | Germany | D02G 3/04 |
| 1251676 | 10/1971 | United Kingdom | D06M 15/00 |

OTHER PUBLICATIONS

*Polyester Fibres*, H. Ludewig, Wiley—Interscience, 1964, p. 429 (no month).

*Primary Examiner*—Deborah Jones

*Attorney, Agent, or Firm*—Gary L. Griswold; Walter N. Kirn; Gregory D. Allen

[57] ABSTRACT

A composite polyester/viscose spun yarn comprising polyester fibers and viscose fibers, fabrics comprising the polyester/viscose spun yarns, and a method of making the same are taught. The fabric is useful as a backing for coated abrasive articles.

38 Claims, No Drawings

POLYESTER/VISCOSE COMPOSITE YARNS AND FABRIC MATERIAL CONTAINING SAID YARNS AS FLEXIBLE COATED ABRASIVE SUPPORT

FIELD OF THE INVENTION

The present invention relates to composite polyester/viscose spun yarns and fabrics containing the same. The present invention also relates to a method of making composite polyester/viscose spun yarns and fabrics containing the same.

DESCRIPTION OF THE RELATED ART

Conventional, flexible backing for coated abrasive articles include cloth fabrics containing combed cotton yarn (e.g., combed Egyptian cotton yarn). Such flexible backings are woven textiles typically prepared by weaving a sized combed cotton warp yarn and an unsized combed cotton weft yarn.

The warp yarns are typically sized to aid in the consolidation of the warp yarns during weaving. The sizing agent, however, decreases the adhesiveness of materials attached to the sized fibers. To improve the adhesive coupling, as well as the flexibility and surface qualities of the woven fabric, the warp yarns are usually desized by conventional desizing techniques. The desized warp yarns are usually then stretched in an aqueous-based solution or dispersion. The woven fabric optionally is presized, backsized, or both.

The resulting woven fabric is then coated on one face (preferably, the front face) with an abrasive layer comprising a bonding material and abrasive grains or particles.

The commercial success of woven textile backings comprising combed cotton yarn resides in the qualities of flexibility, surface condition and cohesion, and, most particularly, tensile strength. Woven fabric comprising combed Egyptian cotton yarn, when conditioned at zero percent relative humidity and at a temperature of about 20°-25° C., generally have a weight of up to 220 g, a tensile strength in the warp direction of about 140 daN/5 cm and a tensile strength in the weft direction of about 60 daN/5 cm.

There have been several attempts, with varying degrees of success, to make suitable woven fabrics for use as coated abrasive backings from fibers other than the relatively expensive cotton fibers.

For example, U.S. Pat. No. 3,316,072 (Voss) states the use of synthetic fibers such as polyester fibers in fabrics used as backings for coated abrasive have not been successful because the adherence of adhesives to the synthetic fibers is practically nil. To overcome this adhesion problem, patentee made yarns having synthetic fiber cores with a sheath of cellulose fibers. Although patentee states woven fabric made from the composite cotton/synthetic yarn has higher tensile strength and greater resistance to tear than woven fabric made with conventional cotton yarn, woven fabric made from the composite cotton synthetic yarn is slightly less flexible than woven fabric made from conventional cotton yarn.

U.S. Pat. No. 4,035,961 (Pemrick et al.), which teaches a woven heat stretched fabric of polyester yarns, states that the use of fabrics made from man-made fibers, with the exception of polynosic rayon, have had limited success as coated abrasive backings because of poor adhesion of the coated abrasive bond system to the fabric.

U.S. Pat. No. 4,282,011 (Terpay) discloses a woven fabric comprising glass fibers cushioned from each other by organic fibers (e.g., fibers of cotton, polyester, polyester-cotton blend, nylon, wool, acrylic, acetate, and mixtures thereof) in the warp direction and organic fibers in the weft direction.

Great Britain Pat. No. 1,251,676, published Oct. 27, 1971, teaches a method of making a fabric comprising interweaving weft yarns and sized warp yarns; finishing the resulting woven fabric with a finishing agent which contains an organic solvent emulsified in an aqueous medium, the organic solvent being a swelling agent at temperatures of 15 to 45° C. and a solvent at temperatures above 65 to 200° C.; and heating the finished fabric to a temperature at which the organic solvent is a solvent for the size on the warp yarns so that the finish is bonded to the size. By virtue of the inclusion of the emulsified organic solvent in the finishing agent, the finish is finely adhered to the size on the warp yarns, providing a surface to which adhesives can satisfactorily be adhered. Suitable yarn materials are said to include fibers of cotton, polynosic, rayon, polyester, polyamide, and polyacrylonitrile, depending on the particular proportion and type of fiber, as well as the particular properties (e.g., wet strength) desired.

French Pat. Appl. No. 2,578,860, published Sep. 19, 1986, discloses a co-textured yarn comprising at least two continuous multifilamentary filaments (a synthetic filament such as those made of polyamide, polyester, polyolefin, and polyvinyl chloride and an artificial cellulosic filament such as those made of rayon) which are twisted together.

SUMMARY OF THE INVENTION

The present invention provides a composite polyester/viscose spun yarn comprising viscose fibers and polyester fibers. Preferably, the composite polyester/viscose spun yarn comprises viscose fibers in the range from about 35 to about 70 percent by weight and polyester fibers in the range from about 65 to about 30 percent by weight, based on the total weight of the composite polyester/viscose spun yarn. The polyester/viscose spun yarn can further comprise conventional fibers such as fibers of cotton, polyamide, acrylic, and combinations thereof.

In another aspect, the present invention provides a fabric material comprising at least 25 percent by weight of composite polyester/viscose spun yarns according to the present invention, wherein the fabric has a dry weight up to about 350 g/m$^2$. The term "dry weight" as used herein refers to the weight per unit area of a fabric conditioned at zero percent relative humidity and at a temperature of about 20 to 25° C.

In another aspect, the present invention provides a method for wet stretching the woven fabric, the method comprising the steps of:

(a) providing a woven fabric having sized warp yarns, the woven fabric comprising at least 25 percent by weight of composite polyester/viscose spun yarn according to the present invention, wherein the woven fabric has a dry weight up to about 350 g/m$^2$;

(b) stretching the sized woven fabric parallel to the warp yarns in an aqueous environment (i.e., while it is wetted by an aqueous-based solution or dispersion); and (c) drying the stretched woven fabric at a temperature of at least about 90° C.

Fabric according to the present invention has strength, stretch, flexibility, and adhesive adherence properties equal to or better than comparable fabric materials made from combed cotton fibers. Surprisingly, fabric according to the present invention has such flexibility and adhesive adherence properties without the need to desize the fabric.

The method according to the present invention for wet stretching woven fabric comprising the polyester/viscose spun yarn is advantageous over wet stretching methods which use organic solvent-based solutions or dispersions because use of an aqueous-based solution or dispersion eliminates the safety hazards of organic solvents from personnel and from the environment.

The fabric material according to the present invention is useful as a backing or support member for a coated abrasive article.

DETAILED DESCRIPTION OF THE PREFERRED EMBODIMENTS

Suitable viscose fibers include rayon fibers, spun staple rayon fibers, and combinations thereof. The preferred viscose fibers are spun staple rayon fibers. Viscose fibers are commercially available, for example, under the trade designation "LENZING MODAL HIGH TENACITY FIBERS" from Lenzing Ltd. of Lenzing, Austria.

The viscose fibers preferably have a high tenacity such that a composite polyester/viscose spun yarn according to the present invention, when conditioned at about 65 percent relative humidity and at a temperature at about 20° C., has a tenacity of at least about 25 cN/tex.

Preferably, the viscose fibers have a staple length in the range from about 32 to about 40 mm and a linear density in the range from about 1.3 to about 1.7 dtex.

Suitable polyester fibers are commercially available, for example, under the trade designation "TERGAL T111 FIBER" from Rhone-Poulenc Ltd. of France.

The polyester fibers preferably have a staple length in the range from about 25 to about 50 mm and a linear density in the range from about 1.3 to about 1.7 dtex. More preferably, the polyester fibers have a linear density in the range from 1.3 to about 1.5 dtex.

The yarn is spun from the fibers using conventional spinning techniques such as ring spinning.

Preferably, the composite polyester/viscose spun yarn according to the present invention has, when conditioned at about 65 percent relative humidity and at a temperature of about 20° C., metric number of at least about 28 m for about I gram, and a tenacity of greater than about 20 cN/tex, and more preferably, a tenacity of at least about 25 cN/tex.

A fabric according to the present invention comprising composite polyester/viscose spun yarns comprising substantially greater than about 65 percent viscose fibers typically has inferior stretch (i.e., excess stretch) and break strength properties as compared to fabric comprising about 65 percent by weight viscose fibers. On the other hand, a fabric material according to the present invention comprising composite polyester/viscose spun yarns comprising substantially less than about 30 percent by weight viscose fibers typically has inferior flexibility as compared to fabric comprising greater than about 35 percent by weight viscose fibers. The most preferred weight ratio of polyester fibers to viscose fibers is about 1:1. A fabric comprising a polyester/viscose spun yarn comprising such a polyester fiber to viscose fiber weight ratio typically exhibits the optimum compromise of strength, stretch, and flexibility.

The fabric according to the present invention preferably comprises at least 25 percent by weight of the composite polyester/viscose spun yarns.

The fabric according to the present invention can be one of a nonwoven fabric, a woven fabric, or a knitted fabric. The most preferred fabric is woven and comprises spun staple rayon fibers and polyester fibers, wherein the weight ratio of polyester fibers to viscose fibers is about 1:1.

Woven fabric can be made using conventional techniques such as rapier weaving, air jet weaving, water jet weaving, or fly-shuttle looming. Nonwoven fabric can be made, for example, using conventional air lay, mechanical, wet lay, spun bond, or stitchbond techniques. Knitted fabric can be made using conventional techniques such as stitchbonding.

A woven fabric according to the present invention has at least one of warp yarns or weft yarns comprising the composite polyester/viscose spun yarns. The woven fabric can further comprise one of yarns comprising polyester fibers, viscose fibers, cotton fibers, polyamide fibers, acrylic fibers, and combinations thereof. Preferably, the fabric according to the present invention has a dry weight in the range from about 80 to about 300 g/m$^2$. More preferably, the fabric material has a dry weight corresponding to one of the known varieties of textile fabrics such as J weight (i.e., having a dry weight in the range from about 160 to about 200 g/m$^2$), X weight (i.e., having a dry weight in the range from about 220 to 260 g/m$^2$), and Y weight (i.e., having a dry weight in the range from about 260 to about 300 g/m$^2$).

A preferred method for wet stretching a woven fabric according to the present invention comprises passing the woven fabric through a conventional aqueous-based solution or dispersion used for wet stretching fabric, while under a load in the range from about 0.25 to about 25 kg/cm, wherein the aqueous-based solution or dispersion is at a temperature in the range from about 15 to about 100° C. To change the color of the woven fabric, the aqueous-based solution or dispersion can contain a conventional dye or colorant.

Preferably, the (wet) stretched woven fabric is dried at a temperature in the range from about 110 to about 200° C.

The fabric according to the present invention can optionally be presized or backsized with conventional materials for this purpose. The presize or backsize material can be applied to the fabric using conventional coating techniques.

Preferably, the woven fabric according to the present invention, when conditioned at about 65 percent relative humidity and at a temperature at about 20° C., has a tensile strength of at least about 70 daN/5 cm.

The fabric according to the present invention can be used as a backing for a coated abrasive article. Preferably, the fabric material is a woven fabric. Such a woven fabric material, when conditioned at about 65 percent relative humidity and at a temperature of about 20° C. has a lengthwise elongation value up to about 8 percent under a load of about 90 daN/5 cm. More preferably, the woven fabric, when conditioned at about 65 percent relative humidity and at a temperature of about 20°

C. has a lengthwise elongation value in the range of about 4.5 percent under a load of about 90 daN/5 cm.

A coated abrasive article according to the present invention may be in any conventional form, including those having a abrasive layer comprising a make layer, abrasive grains, a size layer, etc., and other functional layers (e.g., a supersize layer), and those having an abrasive monolayer derived from a slurry layer comprising a bond system and abrasive grain, and other functional layers.

With the exception of the woven fabric backing according to the present invention, the coated abrasive article can be prepared using materials and techniques known in the art for constructing coated abrasive articles. The preferred bond system is a resinous or glutinous (e.g., hide glue) adhesive. Examples of typical resinous adhesive include phenolic resins, urea formaldehyde resins, melamine- formaldehyde, epoxy resins, acrylate resins, urethane resins, and combinations thereof. The bond system may contain other additives which are well known in the art, such as, grinding aids, plasticizers, fillers, coupling agents, wetting agents, dyes, and pigments. Preferably, the abrasive grains are selected from such known grains as fused aluminum oxide, heat-treated aluminum oxide, ceramic aluminum oxide, co-fused alumina zirconia, emery, flint, garnet, silicon carbide, diamond, cubic boron nitride, and combinations thereof.

Examples of useful materials which may be used in the supersize coat may include the metal salts of fatty acids, urea-formaldehyde, novolak phenolic resins, waxes, mineral oils, and fluorochemicals. The preferred supersize produces a metal salt of fatty acid such as zinc stearate.

In a preferred conventional method for preparing a coated abrasive article, a make coat is applied to a major surface of the fabric according to the present invention followed by projecting a plurality of abrasive grains into the make coat. It is preferable in preparing the coated abrasive that the abrasive grains be electrostatically coated. The make coating is cured in a manner sufficient to at least partially solidify it such that a size coat can be applied over the abrasive grains. Next, the size coat is applied over the abrasive grains in the make coat. Finally, the make coat size coats are fully cured. Optionally, a supersize coat is applied over the size coat and cured.

In another preferred conventional method for preparing a coated abrasive article, a slurry containing abrasive grains dispersed in a bond material, is applied to a major surface of the backing. The bond material is then cured. Optionally, a supersize coat is applied over the slurry coat and cured.

In the above methods, the make coat and size coat or slurry coat can be solidified or cured by means known in the art, for example, heat or radiation energy.

The coated abrasive article can be in the shape of conventional coated abrasive articles, for example, disc, sheets, belts, and strips.

Objects and advantages of this invention are further illustrated by the following examples, but the particular materials and amounts thereof recited in these examples, as well as other conditions and details, should not be construed to unduly limit this invention. All parts and percentages are by weight unless otherwise indicated.

EXAMPLES

EXAMPLE 3

Examples 1–3 illustrate the preparation of composite polyester/viscose spun yarns. The polyester fibers (commercially available under the trade designation "TERGAL T111 FIBER" from Rhone-Poulenc Ltd.) had a denier of about 1.5 dtex, a staple length of about 38 mm (over a range of about 30 to about 40 mm), a tenacity of about 62 to about 64 cN/tex (fiber conditioned at 65 percent relative humidity and at a temperature of about 20° C.) and a elongation at break of about 16 percent at break (fiber conditioned at about 65 percent relative humidity and at a temperature of about 20° C.). The viscose fibers were spun staple rayon fibers (commercially available under the trade designation "LENZING MODAL HIGH TENACITY FIBERS" from Lenzing Ltd.) which had a denier of about 1.7 dtex, a staple length of about 40 mm, a tensile strength of about 4 to 36. cN/tex (fiber conditioned at about 65 percent relative humidity and at a temperature of about 20° C.) and an elongation at break of about 13 to 15 percent at break (fiber conditioned at about 65 percent relative humidity and at a temperature of about 20° C.).

The polyester fibers and spun staple rayon fibers were made into composite polyester/spun staple rayon yarns having a polyester fiber to spun staple rayon fiber weight ratio of about 1 to i using the conventional ring spinning technique, wherein the fibers were twisted in the range from about 600 to about 850 twists per meter of length. The polyester and spun staple rayon fibers were then carded, doubled, and stretched. The resulting yarns, Examples i to 3, had metric values of 34, 40, and 50 meters for 1 gram (i.e., metric number) (mn of 34, 40, and 50).

The following comparative examples were also prepared. Comparative A, a polyester yarn, consisted essentially of polyester fibers ("TERGAL T111 FIBERS"). Comparative B, spun staple rayon yarn, consisting essentially of spun staple rayon fibers ("LENZING MODAL HIGH TENACITY FIBERS"). Comparative C, combed Egyptian cotton yarn, consisted essentially of combed Egyptian cotton fibers (commercially available from Hoffe of Salle, Germany). Comparative D, a composite polyester/Egyptian cotton yarn, consisted essentially of about 50 weight percent polyester fibers ("TERGAL T111 FIBERS"), and about 50 weight percent combed Egyptian cotton fibers (from Hoffe).

The tenacity and elongation at break for each yarn, when conditioned at about 65 percent relative humidity and at a temperature of about 20° C., are provided in Table 1 below.

The results in Table I below show the similarity in tenacity and elongation at break of a composite polyester/viscose spun yarn according to the present invention to a combed Egyptian cotton yarn.

TABLE 1

| Example | Metric Numbers | Twists per unit length, twists/meter | Tenacity,* cN/tex | Elongation, percent |
|---|---|---|---|---|
| 1 | 34 | 619 | 26.0 | 12.0 |
| Comparative A | 34 | | 32.0 | 16.0 |
| Comparative B | 34 | | 23.0 | 10.8 |
| Comparative C | 34 | | 16.0 | 7.0 |
| Comparative D | 34 | 651 | 20.8 | 11.1 |
| 2 | 40 | 690 | 25.0 | 11.8 |
| Comparative | 40 | 725 | 20.0 | 10.6 |

TABLE 1-continued

| Example | Metric Numbers | Twists per unit length, twists/meter | Tenacity,* cN/tex | Elongation, percent |
|---|---|---|---|---|
| D-2 | | | | |
| 3 | 50 | 801 | 23.0 | 11.5 |
| Comparative D-3 | 50 | 841 | 19.5 | 10.5 |

*yarn conditioned at about 65 percent relative humidity and at a temperature of about 20° C.

EXAMPLES 4–6

Examples 4 to 6 illustrate the preparation of a woven fabric according to the present invention. The weight of the woven fabric was in the range from about 160 to about 200 g/m$^2$, which corresponds to what is conventionally known as J-type woven fabric (i.e., "jean"). The weave of the woven fabric was armored serge (i.e., drill weave) (2/1).

The warp yarn used to prepare Examples 4 to 6 was a polyester/rayon spun yarn (P/R) comprising about 50 percent by weight polyester fibers ("TERGAL T111 FIBERS") and about 50 percent by weight spun staple rayon fibers ("LENZING MODAL HIGH TENACITY FIBERS").

The weft yarn for Examples 4–6 was either the polyester/rayon spun yarn used as the warp yarn or a yarn comprising American cotton (A-cotton) fibers (commercially available from Perrin of Cornimont, France). Prior to weaving the yarns, the warp yarns were sized by a conventional sizing means, wherein the warp yarns were impregnated by passing them through an aqueous-based bath which left a superficial deposit around the composite yarn. The aqueous-based bath comprised about 100 parts water, 4 parts carboxymethylcellulose-polyvinyl alcohol (commercially available under the trade designation "ROTTA 989" from Rotta Ltd.) in about 2 parts carboxymethylcellulose (commercially available under the trade designation "CMC P 400" from Sopatis Ltd.). The temperature of the aqueous-based bath during the sizing was in the range from about 75°–85° C.

The fabrics of Examples 4 to 6 were prepared from the yarns using conventional weaving methods. The metric numbers of the yarns used and the number of threads per unit length are listed in Table 2, below.

Comparatives E, F, and G were prepared as described above for Examples 4 to 6 except the warp and weft yarns were comprised of Egyptian cotton (E-cotton) fibers (from Hoffe). The metric number of the fibers used to prepare the comparative examples and the number of threads per unit length are listed in Table 2 below.

The tensile strength in both the warp direction and the weft direction of the fabrics of Examples 4 to 6 and the comparative Examples E, F, and G were measured using a conventional tensile tester (commercially available under the trade designation "LLYOD TYPE M5K" from Lloyd Instruments of South Hampton, UK). Each fabric tested was conditioned at about 65 percent relative humidity and at a temperature of about 20° C. The sample width was about 50±0.5 mm. The distance between the jaws was about 200±1 mm. The speed was about 100 mm/minute. The load for the elongation test was about 90 daN/5 cm. The results are listed in Table 2 below.

TABLE 2

| Examples | Yarn | Warp Threads/cm | mN | Yarn | Weft Threads/cm | mN | Weight, g/m$^2$ | Tensile strength in warp direction,* daN/5 cm | Tensile strength in weft direction,* daN/5 cm |
|---|---|---|---|---|---|---|---|---|---|
| 4 | P/R | 38 | 34 | P/R | 24 | 40 | 170 | 128 | 65 |
| 5 | P/R | 38 | 40 | P/R | 24 | 50 | 151 | 96 | 52 |
| 6 | P/R | 38 | 34 | A-Cotton | 24 | 50 | 160 | 129 | 35 |
| Comparative E | E-Cotton | 38.5 | 34 | E-Cotton | 26.5 | 34 | — | 130–135 | 75–80 |
| Comparative F | E-Cotton | 37 | 34 | E-Cotton | 20.5 | 40 | — | 120–125 | 45–50 |
| Comparative G | E-Cotton | 34 | 34 | E-Cotton | 24 | 40 | — | 120–125 | 45–50 |

*Fabric conditioned at about 65 percent relative humidity and at a temperature of about 20° C.

To reduce the water retention of the yarns comprising the fabrics of Examples 4 to 6, which increases the elongation of the fabric, each sample was stretched in an aqueous-based bath as follows.

The aqueous-based bath comprised about 1000 parts water, about 175 parts of a brown-black dye agent (commercially available under the trade designation "CORIACIDE" from ICI Ltd.) and an alkylphosphate-based wetting agent. The temperature of the aqueous-based bath was about 75°–85° C.

Each fabric was passed through the aqueous-based bath under a linear tension of about 1.5 kilograms per centimeter. The fabric was then dried on a heating cylinder at a temperature of about 175° C.

A presized material was then coated the weft yarn face each fabric. The presized material was derived from a resin formulation comprising 150 parts of a thermohardening resin (phenol formaldehyde type at 50 percent solids) about 850 parts of a styrene/butadiene-based latex, about 2 parts of a silicon-based antifoaming agent, and about 11 parts of a anionic emulsion thickening agent. The viscosity of the presize formulation was about 3500 to about 5000 cps. The presize formulation was coated onto the weft yarn face to provide a quantity sufficient to allow front filling of the fabric. The coated presize was dried at a temperature of about 135° C. and provided an average add-on weight to each fabric of about 50±5 g/m$^2$.

The warp face of each fabric was then coated with a backsize material derived from a formulation comprising about 10,000 parts of a styrene/butadiene-based latex, about 20 parts of a silicon-based antifoam agent, and about 3 parts of a dye agent (commercially available under the trade designation "CHLORAZOL BLUE GD LIQUID" from I.C.I. Ltd.).

The backsize formulation was coated onto the warp face of each fabric. The backsize formulation was dried in a temperature of about 100° C. and provided an average dry add-on weight of about 18 to 22 g/m$^2$.

The weight per unit area of presized and backsized Examples 4 and 5, when conditioned at zero percent relative humidity and at a temperature of about 20° C., was about 257 and about 253 g/m$^2$, respectively.

The tensile strength of presized and backsized Examples 4 and 5 in the warp and weft direction were determined as described above. The tensile strength of presized and backsized Examples 4 and 5 in the warp direction were about 170 and about 120 daN/5 cm, respectively. The tensile strength of presized and backsized Examples 4 and 5 in the weft direction was about 75 and about 50 daN/5 cm, respectively.

The elongation at break of presized and backsized Examples 4 and 5 was measured in the warp direction as described above. The elongation at break of presized and backsized Examples 4 and 5 in the warp direction was about 6.5 daN/5 cm.

Various modifications and alterations of this invention will become apparent to those skilled in the art without departing from the scope and spirit of this invention, and it should be understood that this invention is not to be unduly limited to the illustrative embodiments set forth herein.

What is claimed is:

1. A coated abrasive article comprising an abrasive layer on a major surface of a woven fabric backing having warp and weft yarns, wherein at least one of said warp or said weft yarns includes composite polyester-viscose spun yarn such that said fabric backing comprises at least 25 percent by weight of said polyester-viscose spun yarn, based on the total weight of said fabric backing, wherein said polyester-viscose spun yarn comprises staple viscose fibers and staple polyester fibers, wherein said fabric backing has a dry weight up to about 350 g/m$^2$, and wherein said warp yarns are sized.

2. The coated abrasive article according to claim 1, wherein said viscose fibers are present in the range from about 35 to about 70 percent by weight and said polyester fibers are present in the range from about 65 to about 30 percent by weight, based on the total weight of said composite polyester-viscose spun yarn.

3. The coated abrasive article according to claim 1, wherein said viscose fibers are rayon fibers.

4. The coated abrasive article according to claim 1, wherein said viscose fibers have, when conditioned at about 65 percent relative humidity and at a temperature of about 20° C., a tenacity of at least about 25 cN/tex.

5. The coated abrasive article according to claim 1, wherein said polyester-viscose spun yarn has, when conditioned at about 65 percent relative humidity and at a temperature of about 20° C., a metric number of at least about 28 m for about 1 gram, and a tenacity greater than about 20 cN/tex.

6. The coated abrasive article according to claim 1, wherein said viscose fibers have a staple length in the range from about 32 to about 40 mm and a linear density in the range from about 1.3 to about 1.7 dtex, and said polyester fibers have a staple length in the range from about 25 to about 50 mm and a linear density in the range from about 1.3 to about 1.7 dtex.

7. The coated abrasive article according to claim 6, wherein said polyester-viscose spun yarn comprises viscose fibers in the range from about 35 to about 70 percent by weight and polyester fibers in the range from about 65 to about 30 percent by weight, based on the total weight of said composite polyester-viscose spun yarn.

8. The coated abrasive article according to claim 6, wherein said viscose fibers are rayon fibers.

9. The coated abrasive article according to claim 6, wherein said viscose fibers have, when conditioned at about 65 percent relative humidity and at a temperature of about 20° C., a tenacity of at least about 25 cN/tex.

10. The coated abrasive article according to claim 6, wherein said polyester-viscose spun yarn has, when conditioned at about 65 percent relative humidity and at a temperature of about 20° C., a metric number of at least about 28 m for about 1 gram, and a tenacity greater than about 20 cN/tex.

11. The coated abrasive article according to claim 6, wherein said fabric is a woven fabric having weft yarns comprised of one of polyester yarns, cotton yarns, or a combination thereof.

12. The coated abrasive article according to claim 6, wherein said woven fabric backing has a dry weight in the range from about 80 to about 300 g/m$^2$.

13. The coated abrasive article according to claim 6, wherein each of said warp and said weft yarns comprise said polyester-viscose spun yarn.

14. The coated abrasive article according to claim 6, wherein said warp yarns comprise said polyester-viscose spun yarn.

15. The coated abrasive article according to claim 6, wherein said woven fabric backing has a dry weight in the range from about 260 to about 300 g/m$^2$.

16. The coated abrasive article according to claim 6, wherein said woven fabric backing has a dry weight in the range from about 220 to about 260 g/m$^2$.

17. The coated abrasive article according to claim 6, wherein said woven fabric backing has a dry weight in the range from about 160 to about 200 g/m$^2$.

18. The coated abrasive article according to claim 1, wherein said viscose fibers are rayon fibers, and wherein said polyester fibers and said rayon fibers have a weight ratio of about 1:1.

19. The coated abrasive article according to claim 1, wherein said warp yarns comprise said polyester-viscose spun yarn, and said weft yarns comprise one of polyester fibers, cotton fibers, or a combination thereof.

20. The coated abrasive article according to claim 1, wherein said fabric backing has a dry weight in the range from about 80 to about 300 g/m$^2$.

21. The coated abrasive article according to claim 1, wherein each of said warp and said weft yarns comprise said polyester-viscose spun yarn.

22. The coated abrasive article according to claim 1, wherein said woven fabric backing has a dry weight in the range from about 260 to about 300 g/m$^2$.

23. The coated abrasive article according to claim 1, wherein said woven fabric backing has a dry weight in the range from about 220 to about 260 g/m$^2$.

24. The coated abrasive article according to claim 1, wherein said woven fabric backing has a dry weight in the range from about 160 to about 200 g/m$^2$.

25. The coated abrasive article according to claim 1 wherein said warp yarns comprise said polyester-viscose spun yarn.

26. A method of making a coated abrasive article, said method comprising the sequential steps of:

(a) providing a woven fabric having a major surface and warp and weft yarns, wherein at least one of said warp or said weft yarns include composite polyester-viscose yarn such that said woven fabric comprising at least 25 percent by weight of composite polyester viscose spun yarn, based on the total weight of said woven fabric, wherein said polyester viscose spun yarn comprises viscose fibers and polyester fibers, wherein said woven fabric has a dry weight up to about 350 g/m$^2$, and wherein said warp yarns are sized;

(b) stretching said woven fabric in an aqueous environment;

(c) drying said stretched woven fabric at a temperature of at least about 90° C.; and (d) applying an abrasive layer onto said major surface of said woven fabric to provide a coated abrasive article comprising an abrasive layer on a major surface of a woven fabric backing having warp and weft yarns, wherein at least one of said warp or said weft yarns include composite polyester-viscose spun yarn such that said fabric backing comprises at least 25 percent by weight of said polyester-viscose spun yarn, based on the total weight of said fabric backing, wherein said polyester-viscose spun yarn comprises staple viscose fibers and staple polyester fibers, wherein said fabric backing has a dry weight up to about 350 g/m$^2$, and wherein said warp yarns are sized.

27. The method according to claim 26, wherein said drying temperature is in the range from about 110 to about 200° C.

28. The method according to claim 26, wherein said stretching comprises passing said woven fabric through an aqueous-based solution or dispersion under a load in the range from about 0.25 to about 25 kg/cm, said aqueous-based solution or dispersion being at a temperature in the range from about 15 to about 100° C.

29. The method according to claim 26, wherein said woven fabric, when conditioned at 65 percent relative humidity and at a temperature of about 20° C., has a tensile strength of at least about 70 daN/5 cm.

30. The method according to claim 26, wherein said woven fabric, when conditioned at about 65 percent relative humidity and at a temperature of about 20° C., has an elongation value up to about 8 percent under a load of about 90 daN/5 cm.

31. The method according to claim 26, wherein said woven fabric, when conditioned at about 65 percent relative humidity and at a temperature of about 20° C., has an elongation value in the range from about 4.5 to about 5 percent under a load of about 90 daN/5 cm.

32. A method according to claim 26 wherein said viscose fibers have a staple length in the range from about 32 to about 40 mm and a linear density in the range from about 1.3 to about 1.7 dtex, and said polyester fibers have a staple length in the range from about 25 to about 50 mm and a linear density in the range from about 1.3 to about 1.7 dtex.

33. A coated abrasive article comprising an abrasive layer on a major surface of a fabric backing, wherein said fabric backing comprises at least 25 percent by weight of composite polyester-viscose spun yarn, based on the total weight of said fabric backing, said polyester/viscose spun yarn comprising staple viscose fibers and staple polyester fibers, said fabric backing being sized and having a dry weight up to about 350 g/m$^2$.

34. The coated abrasive article according to claim 33, wherein said viscose fibers are present in the range from about 35 to about 70 percent by weight and said polyester fibers are present in the range from about 65 to about 30 percent by weight, based on the total weight of said composite polyester-viscose spun yarn.

35. The coated abrasive article according to claim 33, wherein said viscose fibers are rayon fibers.

36. The coated abrasive article according to claim 33, wherein said viscose fibers have a staple length in the range from about 32 to about 40 mm and a linear density in the range from about 1.3 to about 1.7 dtex, and said polyester fibers have a staple length in the range from about 25 to about 50 mm and a linear density in the range from about 1.3 to about 1.7 dtex.

37. The coated abrasive article according to claim 33, wherein said viscose fibers are rayon fibers, and wherein said polyester fibers and said rayon fibers have a weight ratio of about 1:1.

38. The coated abrasive article according to claim 33, wherein said fabric backing is selected from the group consisting of a nonwoven fabric, a woven fabric, and a knitted fabric.

* * * * *

UNITED STATES PATENT AND TRADEMARK OFFICE

CERTIFICATE OF CORRECTION

PATENT NO. : 5,437,700

DATED : August 1, 1995

INVENTOR(S) : Duquesne

It is certified that error appears in the above-indentified patent and that said Letters Patent is hereby corrected as shown below:

Col. 1, line 42, "g," should be –$g/m^2$,–.

Col. 2, line 34, after "together." the following sentence should be added:
–Although Applicant suggests spinning a yarn from staple fiber and polyester fiber, there does not appear to be a specific mention of spinning viscose (e.g., rayon) fibers and polyester fibers, nor does there appear to be a suggestion of useful ratios of fibers to spin.–.

Col. 3, line 53, "T" should be –1–.

Col. 6, line 3, "EXAMPLE 3" should be –EXAMPLES 1-3–.

Col. 6, line 21, "about 4 to 36" should be –about 34 to 36–.

UNITED STATES PATENT AND TRADEMARK OFFICE

CERTIFICATE OF CORRECTION

PATENT NO. : 5,437,700

DATED : August 1, 1995

INVENTOR(S) : Duquesne

It is certified that error appears in the above-indentified patent and that said Letters Patent is hereby corrected as shown below:

Col. 6, line 29, "about 1 to i" should be --about 1 to 1--.

Col. 6, line 34, "Examples i to 3" should be --Examples 1 to 3--.

Col. 8, line 7, "LLYOD" should be --LLOYD--.

Col. 8, line 46, "A presized material was then coated the weft yarn face each fabric." should be --A presized material was then coated onto the weft yarn face of each fabric.--

Signed and Sealed this

Ninth Day of April, 1996

Bruce Lehman

*Attest:*

BRUCE LEHMAN

*Attesting Officer*

*Commissioner of Patents and Trademarks*